US005762107A

United States Patent [19]

Laws

[11] Patent Number: 5,762,107

[45] Date of Patent: Jun. 9, 1998

[54] FLOW CONDITIONER

[75] Inventor: Elizabeth M. Laws, Bolton, England

[73] Assignee: Den Norske Stats Oljeselskap A.S., Stavanger, Norway

[21] Appl. No.: 605,138

[22] PCT Filed: Sep. 14, 1994

[86] PCT No.: PCT/NO94/00152

§ 371 Date: Apr. 5, 1996

§ 102(e) Date: Apr. 5, 1996

[87] PCT Pub. No.: WO95/08064

PCT Pub. Date: Mar. 23, 1995

[51] Int. Cl.[6] ..... F15D 1/02

[52] U.S. Cl. ..... 138/44; 138/40

[58] Field of Search ..... 138/44, 40, 42, 138/39, 37; 73/861.52

[56] References Cited

U.S. PATENT DOCUMENTS

| | | | |
|---|---|---|---|
| 2,929,248 | 3/1960 | Sprenkle | 73/861.52 X |
| 3,185,181 | 5/1965 | Demyan | 138/37 |
| 3,280,807 | 10/1966 | Bardy | 138/44 X |
| 3,572,391 | 3/1971 | Hirsch | 138/40 |
| 3,798,345 | 3/1974 | Priaroggia et al. | 138/44 X |
| 3,840,051 | 10/1974 | Akashi et al. | 73/861.52 X |
| 4,280,360 | 7/1981 | Kobayashi et al. | 138/44 X |
| 5,309,946 | 5/1994 | Ligneul | 138/39 |
| 5,327,941 | 7/1994 | Bitsakis et al. | 138/44 X |
| 5,341,848 | 8/1994 | Laws | 138/44 |
| 5,495,872 | 3/1996 | Gallacher et al. | 138/44 |
| 5,529,093 | 6/1996 | Gallagher et al. | 138/44 |

FOREIGN PATENT DOCUMENTS

| | | | |
|---|---|---|---|
| 0 538 929 | 4/1993 | European Pat. Off. . | |
| 2034097 | 1/1972 | Germany | 73/861.52 |
| 495532 | 3/1976 | U.S.S.R. | 73/861.52 |
| 1 375 908 | 12/1974 | United Kingdom . | |
| 1476147 | 6/1977 | United Kingdom | 73/861.61 |
| 91/01452 | 2/1991 | WIPO . | |

OTHER PUBLICATIONS

Relevant Portions of "Flow Measurement Engineering Handbook", R.W. Miller, pp. 5–41, 5–42, 5–44, 5–46, 8–6–8–9.

*Primary Examiner*—Patrick F. Brinson
*Attorney, Agent, or Firm*—Foley & Lardner

[57] ABSTRACT

According to the present invention there is provided a flow conditioner for insertion into a pipe of predetermined diameter conveying a fluid flow. The conditioner comprises a plate arranged perpendicular to the flow and having apertures which are located so as to distribute the flow radially in an approximation to the flow distribution in a fully developed flow, and a plurality of vanes distributed such that the normal to each vane is perpendicular to the direction of flow.

18 Claims, 12 Drawing Sheets

FLOW CONDITIONER

The present invention relates to a flow conditioner.

In order to make accurate measurements of the rate of flow of a fluid passing along a pipe, it is necessary to measure the fluid flow at a position along the pipework where that fluid flow is stable. When a fluid passes around a bend in pipework or passes a restriction in the pipework in the form of for example a valve, the fluid flow is disturbed and unpredictable flow velocity, turbulence and swirl results. If the fluid continues to flow along a straight pipe, flow conditions gradually settle until a "fully developed condition" is established. The term "fully developed condition" is used to indicate flow conditions which will not change significantly, assuming that the flow continues along a straight pipe of constant cross-section and uniform internal surface.

It is generally thought that in a straight pipe a fully developed condition can only be relied upon downstream of a bend or other disturbance in a pipe at a distance from the disturbance equal to at least one hundred times the pipe diameter. Flow velocity and turbulence can generally be relied upon to have stabilised after this distance, but swirl can require an even longer settling distance. In many circumstances it is desirable to be able to, for example, measure a flow at a distance of less than one hundred times the pipe diameter from a disturbance, and accordingly it is normal practice to include a flow conditioning device downstream of a disturbance so as to reduce the pipe distance required for the establishment of fully developed flow conditions.

Many flow conditioning devices have been proposed. A useful summary of various designs of flow conditioning devices is contained in the publication "Flow Measurement Engineering Handbook" by R. W. Miller, McCraw Hill Publishing Company. This document describes various conditioning units which are referred to as tube bundles, plate conditioners, Sprenkle conditioners, Etoile conditioners and Zanker conditioners.

Tube bundles are conditioners in the form of a simple bundle of tubes which occupy the full diameter of the main pipe. Typically there will be of the order of twenty pipes in the bundle. Such conditioners are effective in reducing or removing swirl but are not particularly effective at stabilising flow velocity or reducing turbulence. Etoile conditioners are in the form of an array of vanes which meet along the main pipe axis and extend radially to abut the inside wall of the main pipe. Such conditioners are also reasonably effective against swirl, but produce a very poor downstream flow distribution as the solid geometry at its centre gives rise to a distinct wake along the pipe axis which is extremely slow to develop. Plate conditioners are in the form of simple apertured plates of limited axial length, for example of the order of one eighth of the pipe diameter. One such plate conditioner is described in British Patent No. 1375908. In that plate conditioner, the apertures in the plate are not axi-symmetric and therefore the downstream flow conditions are sensitive to the orientation of the flow conditioner relative to the flow. This problem is overcome in the plate flow conditioner described in International Patent Specification No. WO 91/01452 which is axi-symmetric and in which the apertures are arranged such that the impedance to flow presented by the plate increases with the radius on which a given array of apertures is arranged.

The flow conditioner described in WO 91/01452 has been demonstrated to be capable of producing a downstream flow quality which is close to fully developed flow in a relatively short pipe length. For example if the plate conditioner is positioned three pipe diameters downstream of a source of disturbance, the flow quality is close to fully developed flow at a distance of nine pipe diameters downstream from the conditioner. This has enabled the plate conditioner to meet exacting International standards with respect to the time mean flow distribution. This plate conditioner is not so effective, however, in dealing with turbulence and it can be shown to be unable to reproduce in a reasonable pipe length the correct axial turbulence intensity distribution.

The Sprenkle conditioner comprises a series of plates interconnected by supporting rods, each of the plates being provided with a relatively large number of apertures. The Sprenkle conditioner exhibits the same problems as any other plate conditioner and in addition is not able to produce the required flow velocity distribution.

The Zanker conditioner comprises what is in effect a tube bundle in the form of a honeycomb located immediately downstream of an apertured plate which is thin in the axial direction. The honeycomb is defined by two sets of vanes, each set comprising five vanes which are regularly spaced apart across the pipe diameter, and the vanes of one set being perpendicular to the other. Thus the intersecting vanes define a series of sixteen tubes of square section with sixteen smaller tubes arranged around the edge of the pipe. The Zanker conditioner does not provide an acceptable performance, possibly because the upstream plate is too thin to be effective, but certainly because the apertures in the upstream plate are not distributed in an appropriate manner to produce the required flow velocity distribution. In any event, the honeycomb bundle downstream of the plate would not allow stable flow conditions to be maintained downstream of the conditioner even if such conditions could be established immediately downstream of the plate. Furthermore, the downstream honeycomb tube bundle although effective in sealing with swirl cannot produce the required turbulence distribution.

It is an object of the present invention to obviate or mitigate the problems outlined above.

According to the present invention, there is provided a flow conditioner for insertion into a pipe of predetermined diameter conveying a fluid flow, the conditioner comprising an apertured plate and a vane assembly, the plate in use being arranged perpendicular to the flow and defining apertures which are located so as to distribute the flow radially in an approximation to the flow distribution in a fully developed flow, and the vane assembly in use being located upstream of the plate and being formed from a plurality of vanes distributed such that the normal to each vane is perpendicular to the direction of flow.

The combination of a plate capable of dealing with non-uniform flow distributions with an upstream vane assembly enables the best features of plate conditioners to be obtained whilst at the same time suppressing swirl and turbulence. The vanes may be located in contact with or spaced from the upstream side of the plate, the vanes preferably being wholly located within a distance of the plate equal to the diameter of the pipe. The axial length of each vane could be for example, one quarter of the pipe diameter, or more preferably one eighth of the pipe diameter. Thus a structure which is very compact in the axial direction can be provided.

The vanes may be mounted on and extend from the plate. Preferably the vanes are arranged so as not to cut across any of the apertures in the plate. In one arrangement each vane may extend radially from adjacent the pipe wall to adjacent a central aperture in the plate. In an alternative arrangement the vanes may be arranged in two sets which are mutually perpendicular, the vanes in each set being spaced apart so as to define a rectangular array. Such a vane assembly is known from the Zanker conditioner described above but the conditioner differs crucially from the Zanker conditioner in that the vanes are located upstream rather than downstream of the conditioning plate.

Preferably the plate is of the form described in International Patent Specification No WO 91/01452. Alternative conditioning plate configurations can however be used in embodiments of the present invention and still provide an enhanced performance as compared with prior art devices.

In addition to the upstream vane assembly, further vanes may be located downstream of the plate. Such further vanes can be in the form of rectangular plates distributed around the edge of the conditioner plate, extending radially and axially for a distance of approximately one eighth of the pipe diameter.

Embodiments of the present invention will now be described, by way of example, with reference to the accompanying drawings, in which.

Figure 1:
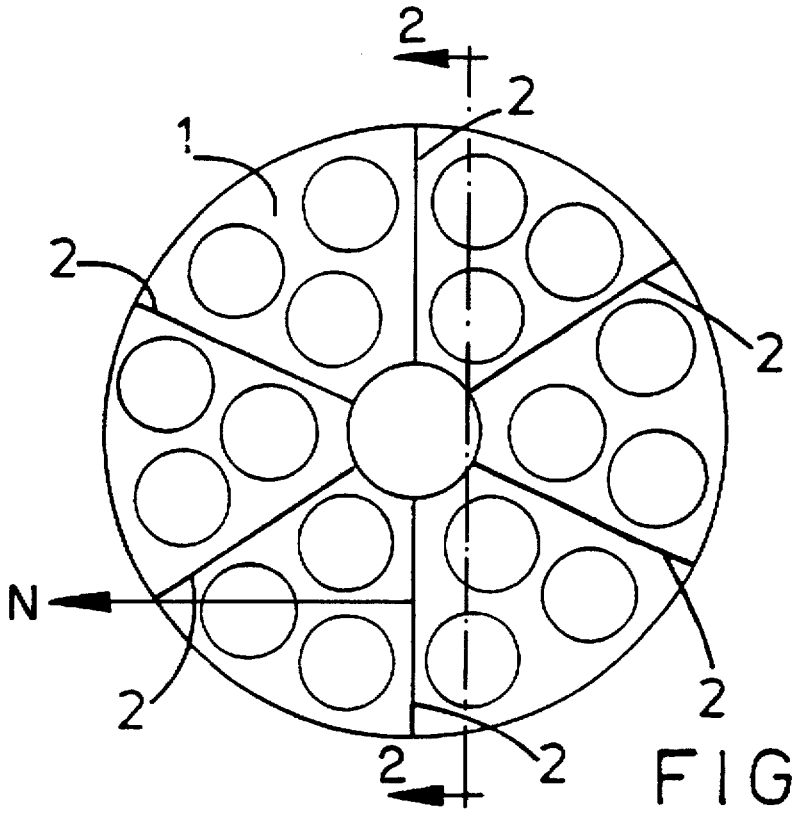
FIG. 1 is a front view of a flow conditioner in accordance with the present invention.
Figure 2:
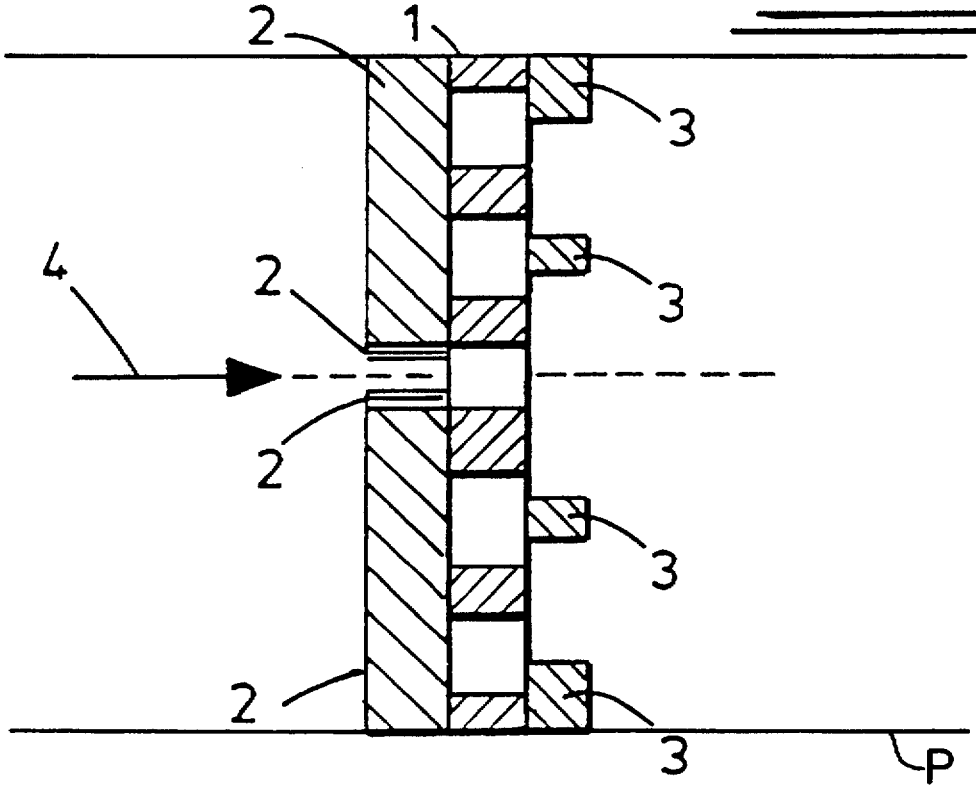
FIG. 2 is a section through FIG. 1 along the line 2—2 of FIG. 1.

Referring to the accompanying drawings, FIGS. 1 and 2 illustrate a preferred embodiment of the present invention. The illustrated conditioner comprises an apertured plate 1 inserted into pipe P. On the upstream side of the plate, six radially extending vanes 2 are supported. Six further plates 3 are mounted on the downstream side of the plate, each of the plates 3 being axially aligned with a respective one of the vanes 2. The normal to the vanes is indicated by arrow N. The direction of flow of the fluid which is to be conditioned by the illustrated device is indicated by arrow 4.

The plate has a central aperture to the edge of which each of the vanes 2 extends. Inner and outer rings of apertures are arranged in a regular array around the central aperture, the inner ring comprising six apertures and the outer ring comprising twelve apertures. The proportion of the plate which is occupied by apertures is 60%. The diameter of the active portion of the plate, that is the diameter of the circle touched by the radially outer edges of the vanes 2, is equal to 103.125 mm. This corresponds to the internal diameter of the pipe in which the conditioner is to be inserted. The diameter of the central aperture in the plate is 21.4 mm, the diameter of each aperture in the inner ring is 20.34 mm, and the diameter of each aperture in the outer ring is 16.93 mm. The thickness of the plate is 12.89 mm, that is one eighth of the internal diameter of the pipe. The axial length of each vane on both sides of the plate is the same as the plate thickness, and the radial length of each of the downstream vanes 3 is equal to the plate thickness. Each of the vanes 2 and 3 is fabricated from a metallic sheet which is 1 mm thick.

Figure 3:
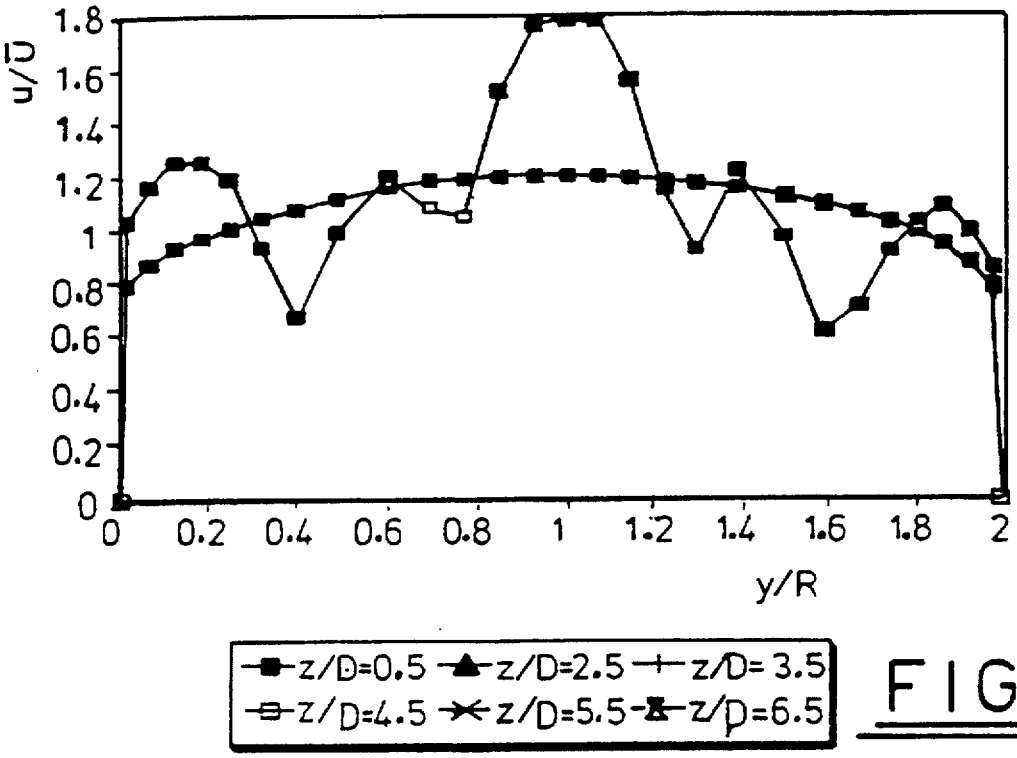
FIGS. 3 to 11 are graphs illustrating the performance of the flow conditioner illustrated in FIGS. 1 and 2.

Referring to FIG. 3, the vertical axis is representative of a non-dimensional velocity and the horizontal axis is representative of a non-dimensional distance corresponding to the position across a diameter of the pipe. The pipe axis corresponds to the centre of the horizontal axis.

FIG. 3 illustrates the performance of the plate of FIGS. 1 and 2, with the plate located three pipe diameters downstream of a ball valve. In the drawings, results are given for three valve positions, that is position A (valve fully open), position B (valve 50% closed), and position C (valve 70% closed). The results are displayed in the form of profiles measured at a distance Z downstream from the plate where the plane Z=0 corresponds to the downstream face of the plate. The velocity U is the local velocity measured across the pipe of diameter D at a distance Y, wherein Y is the distance measured from one inside face of the pipe, the pipe having a diameter of 2R. The non-dimensional velocity value is obtained by dividing the local velocity by the area weighted mean velocity.

Figure 4:
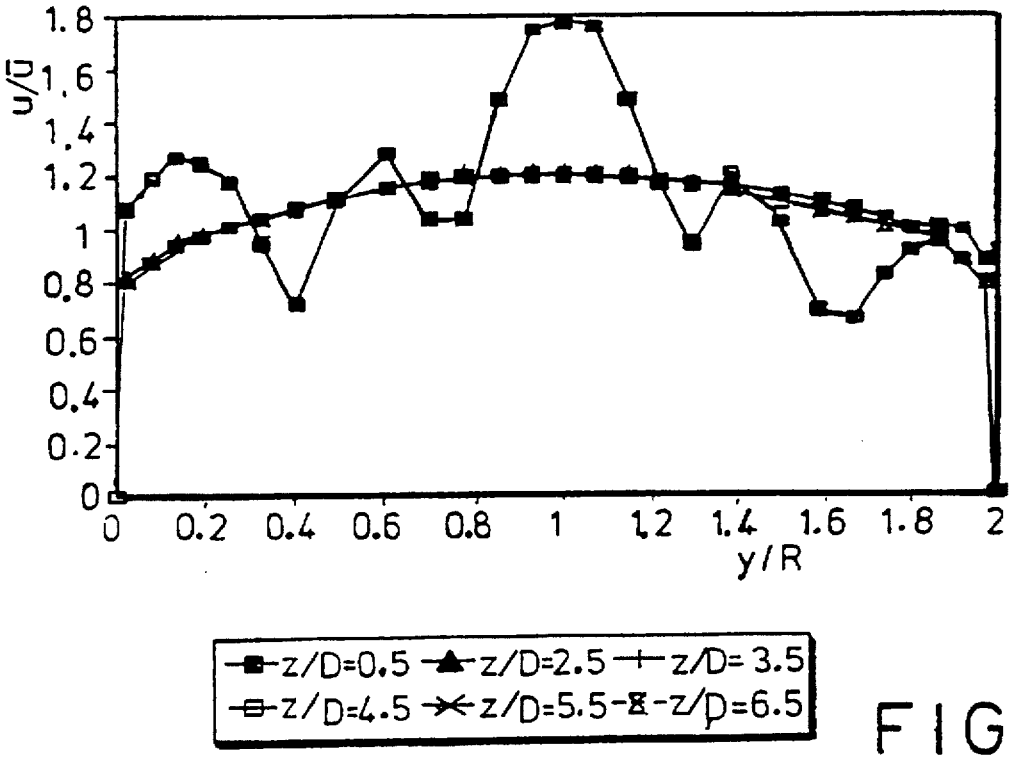
Figure 5:
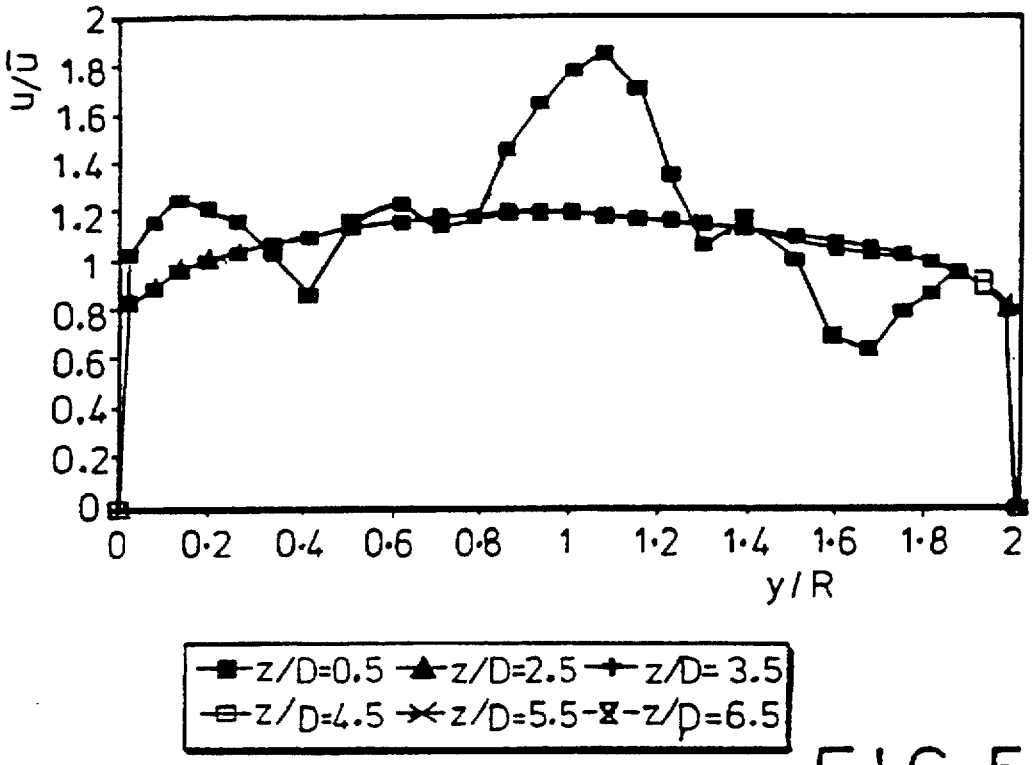
Figure 6:
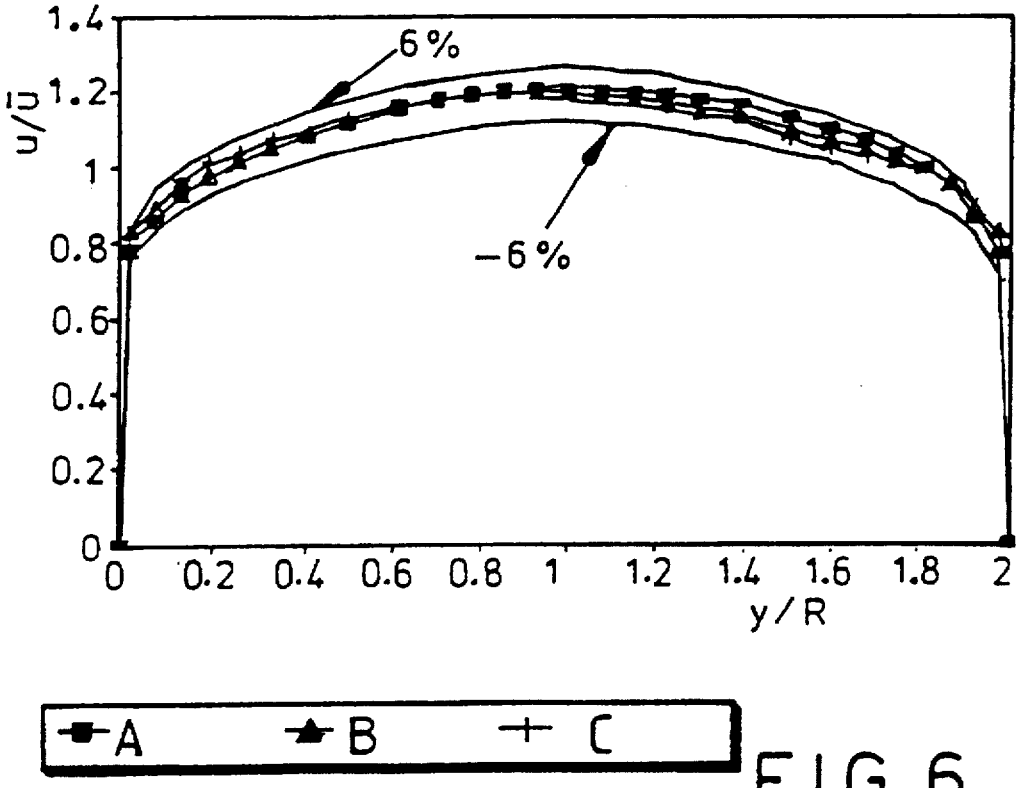

As is apparent from FIGS. 3, 4 and 5, the velocity distribution for all three valve positions has effectively ceased to develop at a distance downstream from the plate of Z/D =2.5. FIG. 3 shows the results with the valve fully open (condition A), FIG. 4 shows the results with a valve in condition B, and FIG. 5 shows the results with the valve in condition C. FIG. 6 compares the velocity profiles at valve positions A, B and C for Z/D=2.5. The lines labelled plus and minus 6% represent the limits permitted in International Standard ISO 5167. Clearly at Z/D=2.5 the flow is well within these limits.

Figure 7:
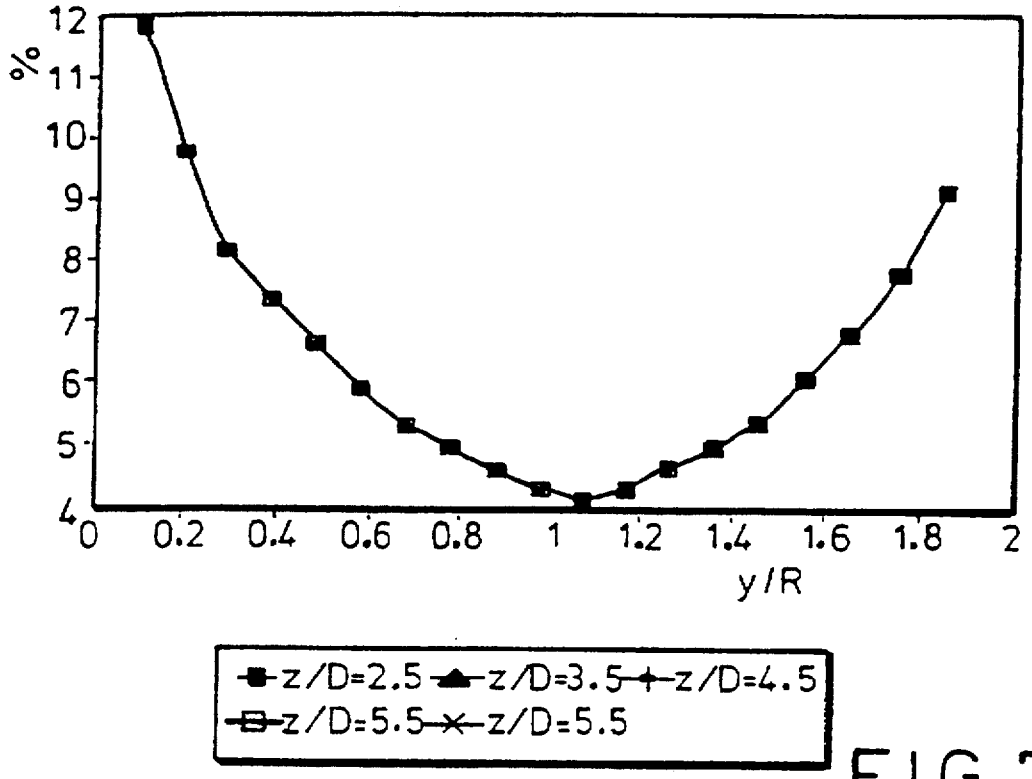
Figure 8:
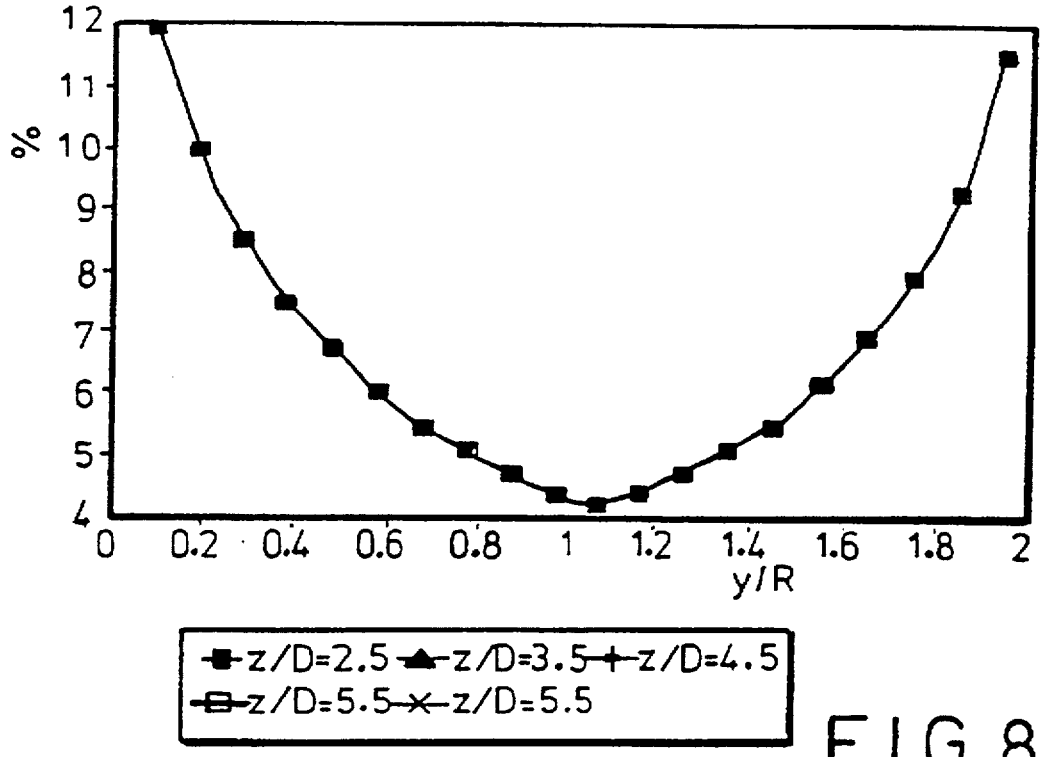
Figure 9:
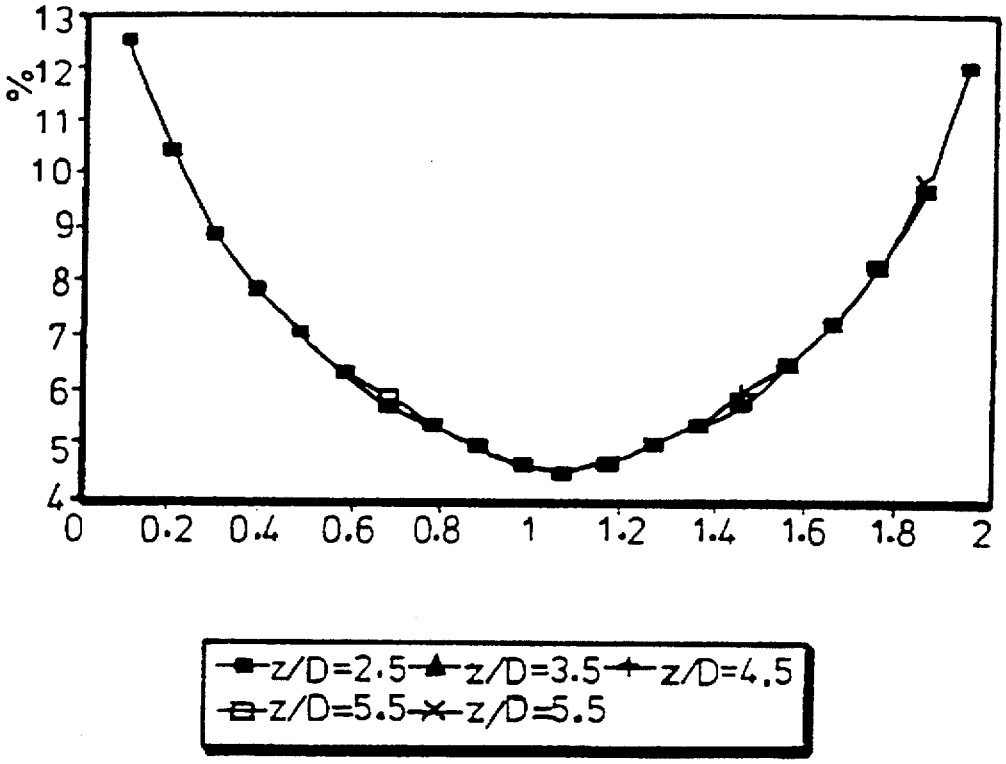
Figure 10:
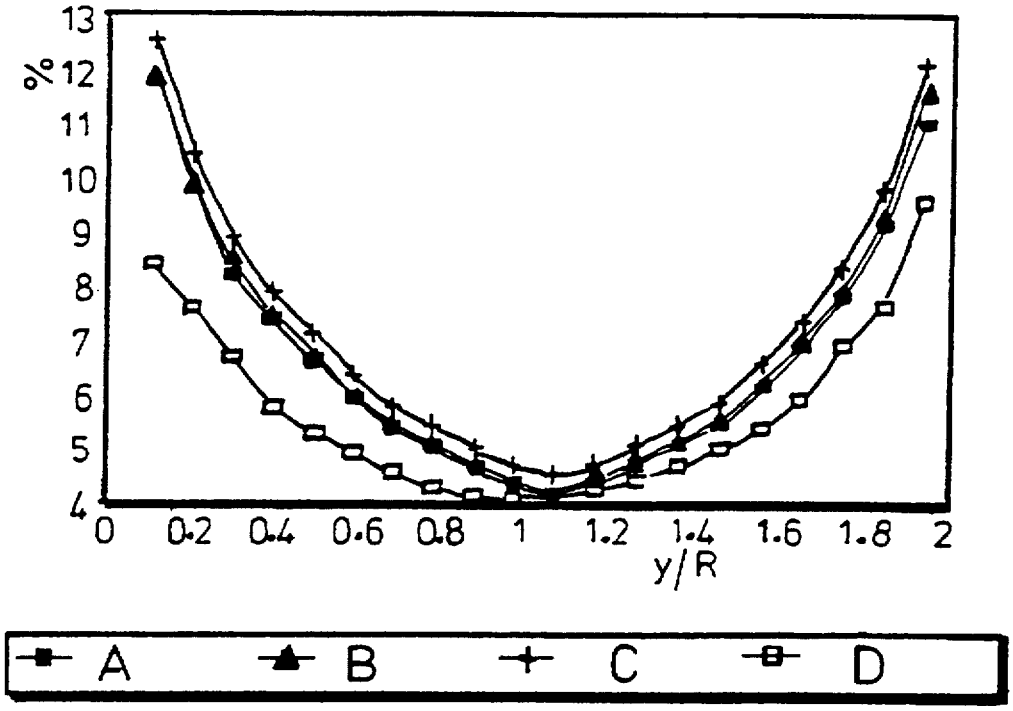

A study of the axial turbulence intensity profiles for the plate of FIGS. 1 and 2 produced the results shown in FIGS. 7 to 9. FIG. 7 shows the axial turbulence intensity in percent with the valve fully open (condition A), FIG. 8 the equivalent results with the valve in condition B, and FIG. 9 the equivalent results for the valve in condition C. FIG. 10 compares the axial turbulence intensity profiles obtained at Z/D=2.5 for the three different valve settings, the curve identified as D corresponding to fully developed flow. The fully developed flow condition was obtained by taking measurements of the flow at a distance of one hundred pipe diameters downstream of the device, there being no disturbances between the device and the measurement point. It is clear that the axial turbulence results were very satisfactory, particularly near the pipe centre line.

Figure 11:
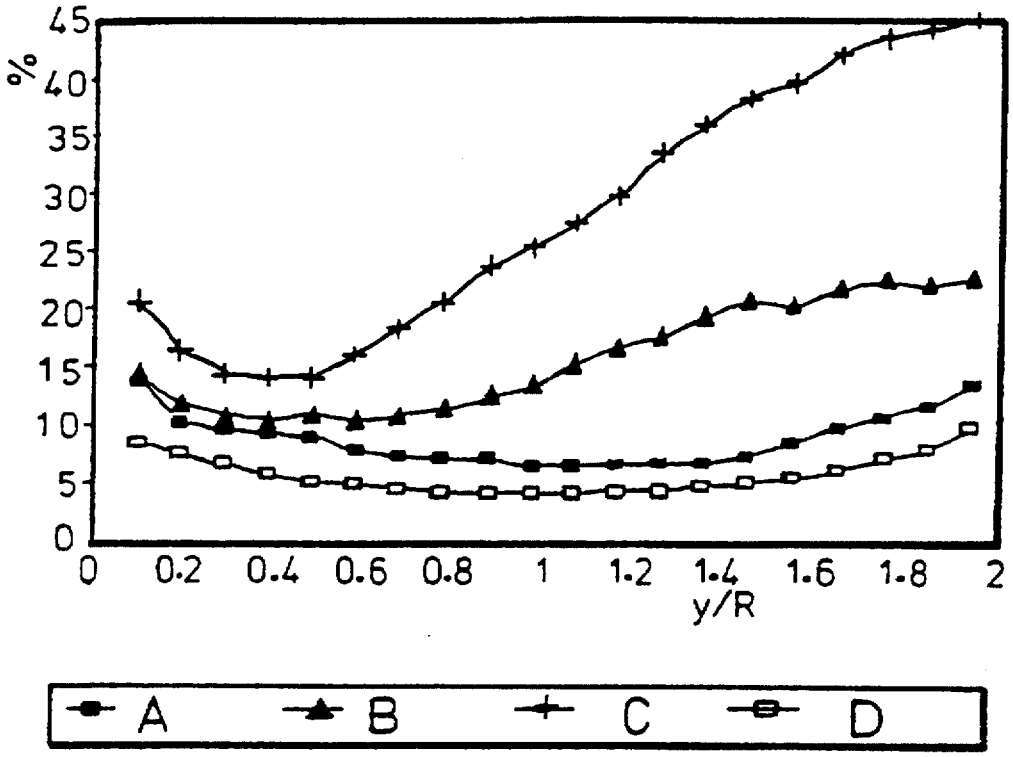

FIG. 11 shows the equivalent results at distance Z/D=2.5 downstream of a conditioner plate corresponding to the plate 1 of FIGS. 1 and 2 without the vanes 2 and 3 of FIGS. 1 and 2. The performance improvement which results by adding the vanes is clearly represented by the difference between FIGS. 10 and 11. For the worst case, with the valve condition C, the axial turbulence level at Z/D=2.5 has a maximum value close to 45% and a distinct asymmetry. The asymmetry is removed and the centre line level drops to close to 4% with the addition of the vanes shown in FIGS. 1 and 2.

Figure 12:
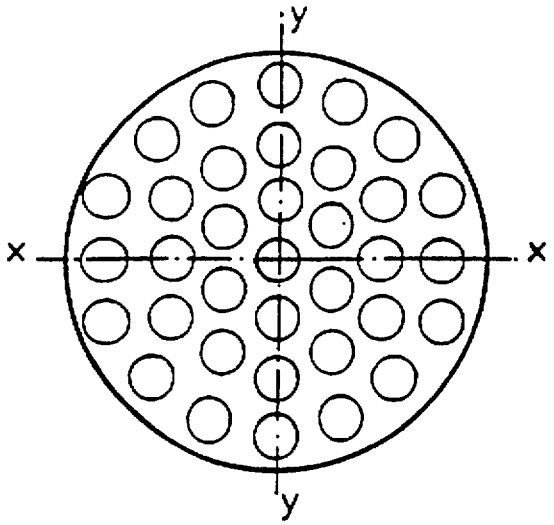
FIG. 12 is a front view of a known apertured plate conditioner of the type described in British Patent Specification No. 1375908.

The embodiment of the invention illustrated in FIGS. 1 and 2 is clearly far superior to prior art devices. Having established that the addition of vanes to the known apertured plate conditioner remarkably improved its performance, tests were conducted by positioning vanes upstream of other flow, conditioning devices. FIG. 12 illustrates the form of a known alternative apertured plate having an axial thickness equal to one eighth of the internal diameter of the pipe. It was found that these plates were not as effective in distributing the flow as the plate incorporated in the arrangement of FIGS. 1 and 2 and therefore it was found necessary to allow a longer settling length downstream of the conditioner before any meaningful comparisons could be made. Also the plate of FIG. 12. is radially asymmetric and it was not therefore possible to mount radially extending vanes of the type shown in FIGS. 1 and 2 on the upstream face of the plate shown in FIG. 12. Accordingly the vanes were positioned so that the downstream edge of the vanes were spaced from the upstream face of the plate of FIG. 12 by a distance equal to half the pipe diameter. As in the case of the embodiment of FIGS. 1 and 2, six vanes were used with a 60° pitch between them.

Figure 13:
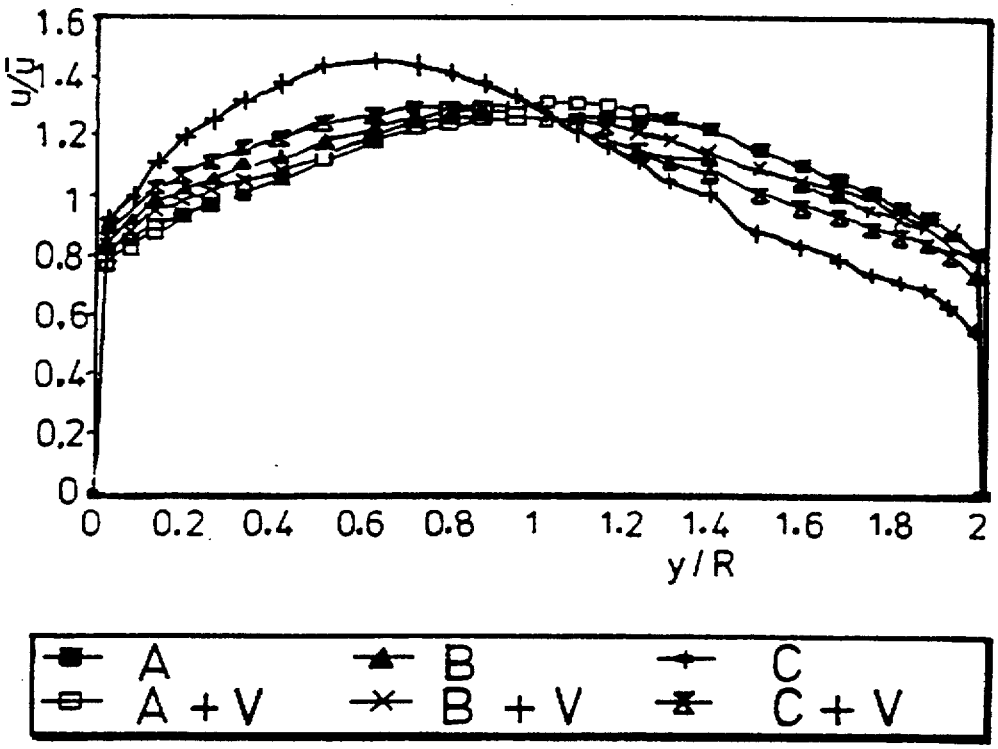
FIGS. 13 and 14 illustrate the performance of a flow conditioner in accordance with the present invention incorporating a plate of the type shown in FIG. 12.

FIG. 13 shows a comparison of the velocity distribution measured at a downstream distance of Z/D=6.5 in the case of the plate of FIG. 12 with and without vanes for the three valve conditions A, B and C. The results corresponding to condition A with vanes is represented in FIG. 13 by the condition A+V. A similar notation is used for the other five cases illustrated. It is clear from FIG. 13 that the addition of the vanes has improved the effectiveness of the plate. This is most apparent from the worst case, that is valve setting C. With the addition of upstream vanes the severe distortion which is evident without the vanes has been significantly reduced.

Figure 14:
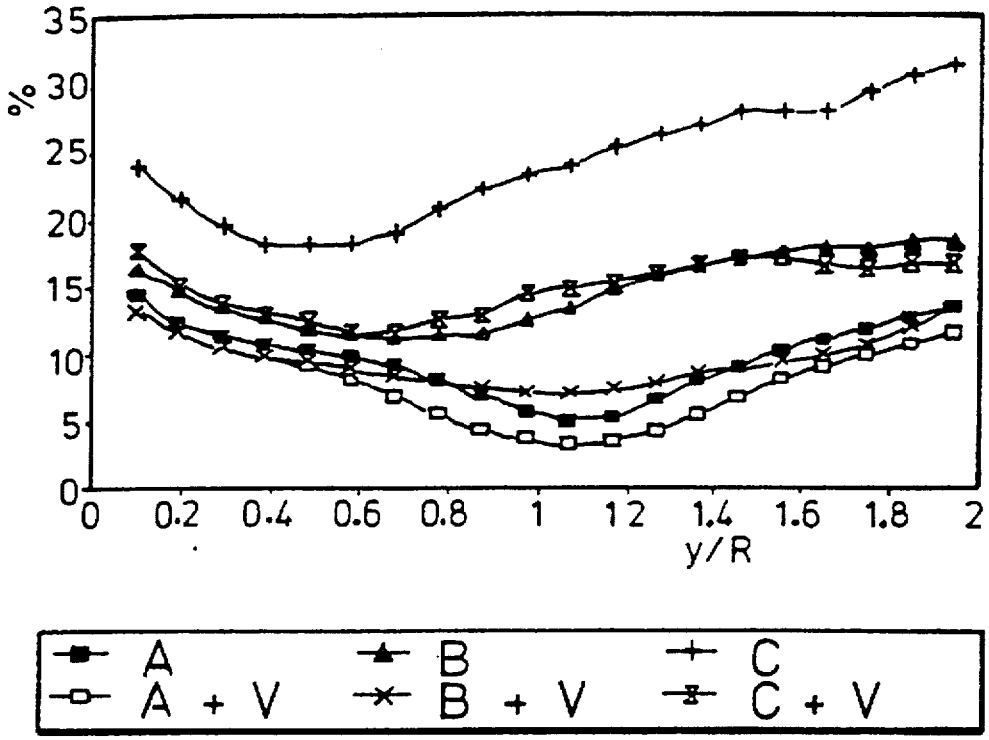

The effectiveness of the upstream vanes is more clearly apparent from FIG. 14 which shows the axial turbulence intensity profiles for the same test conditions as for FIG. 13, the results also being at a distance of Z/D=6.5. Clearly the addition of the upstream vanes produces a significant reduction in the turbulence intensity level for all three valve conditions.

Figure 15:
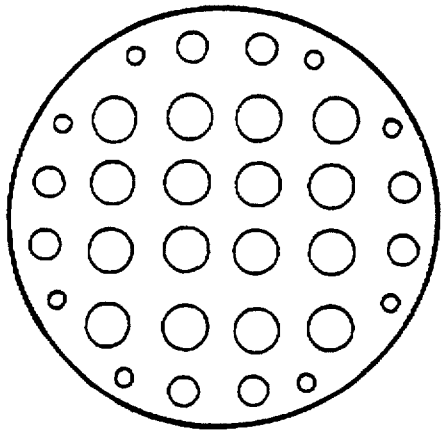
FIG. 15 is a front view of a plate apertured in the manner of a known Zanker conditioner.

FIG. 15 is a front view of a plate having apertures distributed across its surface in the manner of the apertures formed in the end plate of a conventional Zanker conditioner. It will be seen that there are four rows of four apertures in a regular rectangular array, with sixteen further apertures distributed around the periphery. Clearly this is very much an asymmetric distribution and accordingly as in the case of the plate illustrated in FIG. 12 results were derived from measurements taken at a downstream distance of Z/D =6.5.

Figure 16:
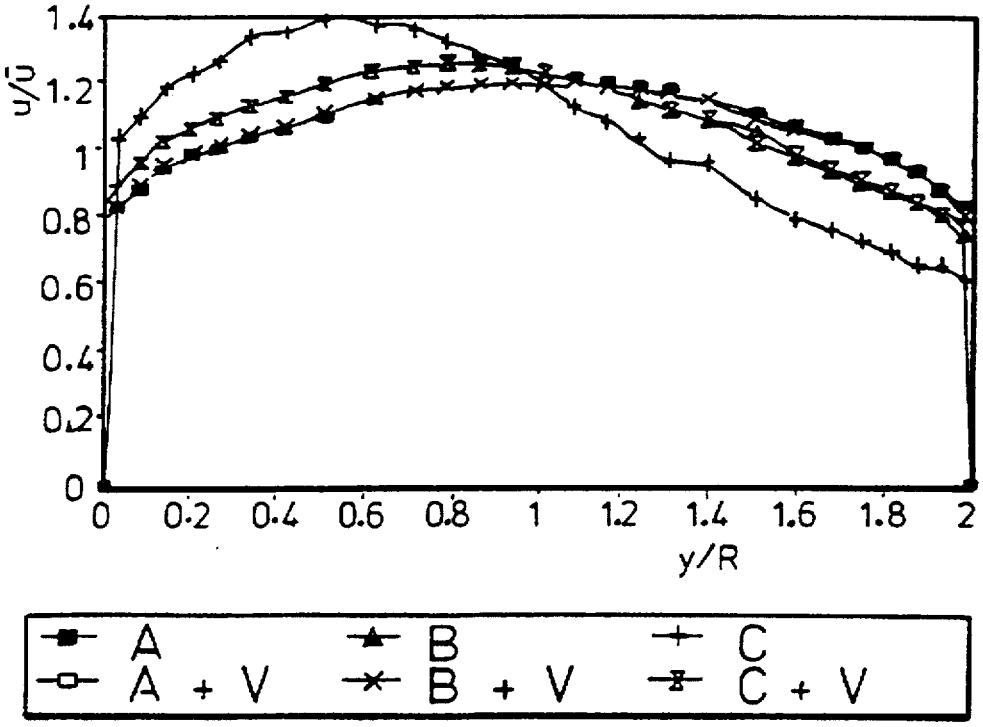
FIGS. 16 and 17 illustrate the performance of an embodiment of the present invention incorporating a plate of the type shown in FIG. 15.

FIG. 16 compares the velocity distribution measured downstream of the plate of FIG. 15 with and without upstream vanes of the type used with the plate of FIG. 12 and described above. It is clear that the time mean velocity profiles with the upstream vanes are closer to the fully developed distribution, with the most significant improvement being seen for the worst case (condition C).

Figure 17:
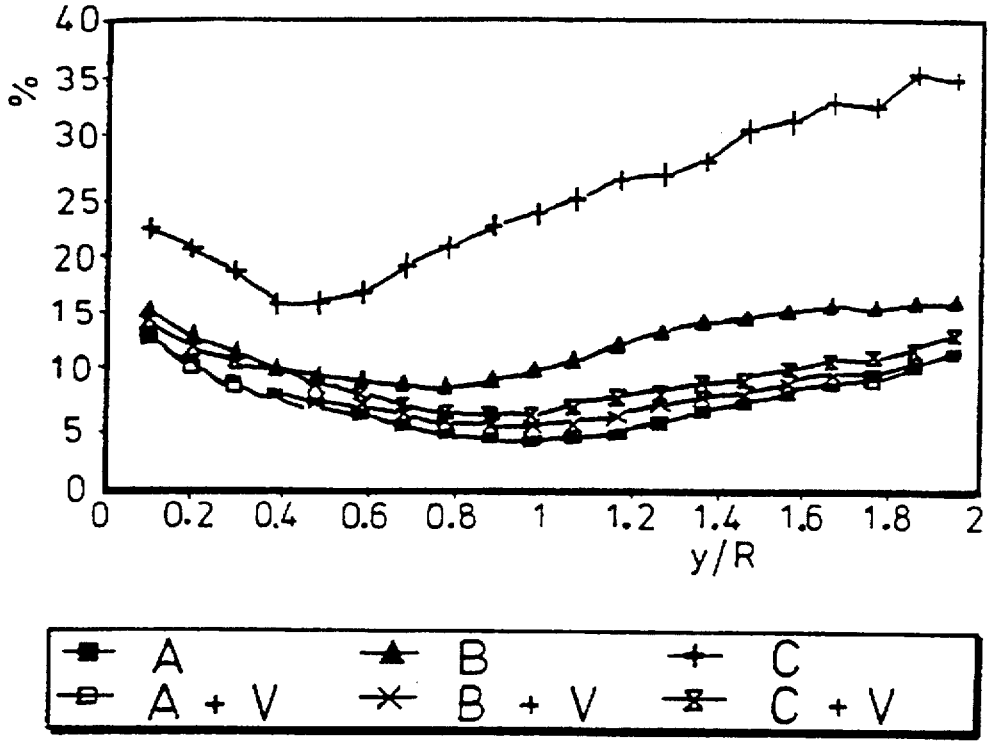

FIG. 17 shows the corresponding axial turbulence intensity measurements, again illustrating the significant benefit of putting vanes upstream of the Conditioner plate. With the upstream vanes the turbulence level is reduced considerably and the profile is much close to that for fully developed flow.

Figure 18:
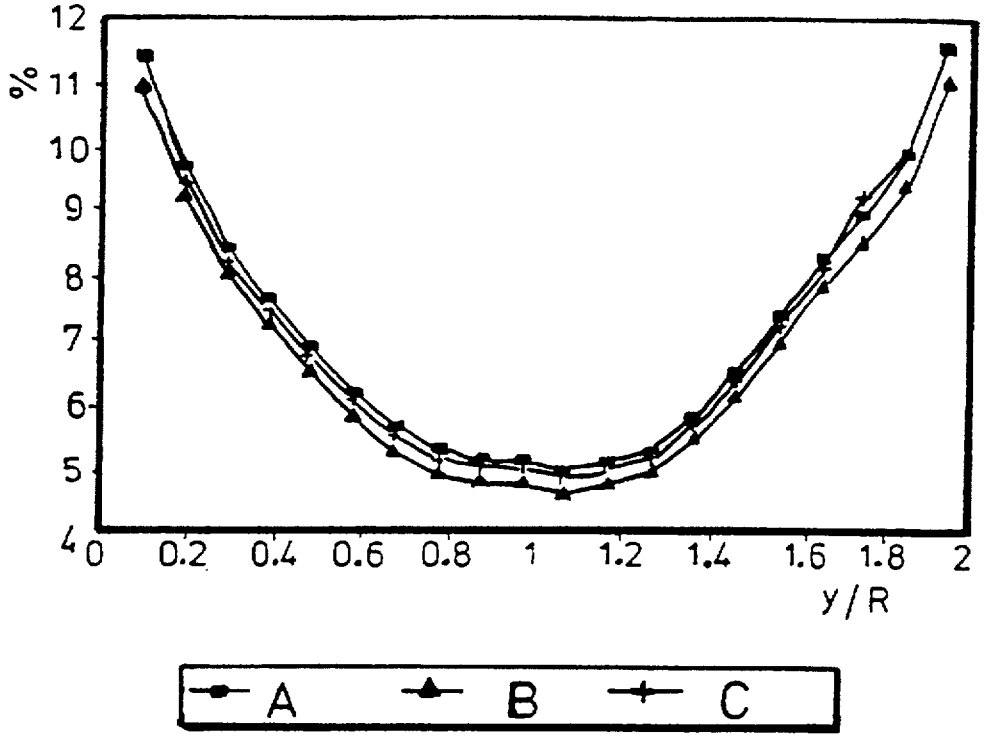
FIG. 18 illustrates the performance of an embodiment of the invention with no downstream vanes.

Given that the addition of vanes only on the upstream side of plates of the type shown in FIGS. 12 and 15 resulted in significant improvements in performance, further results were derived for a plate of the type used in the embodiment of FIGS. 1 and 2, but with a 50% porosity. The upstream vanes were space from the upstream side of the plate by a distance equal to half the pipe diameter. There were no downstream vanes. FIG. 18 compares the axial turbulence intensity profiles measured at Z/D=2.5 for this arrangement. Once again the effectiveness of the vanes is demonstrated.

Figure 19:
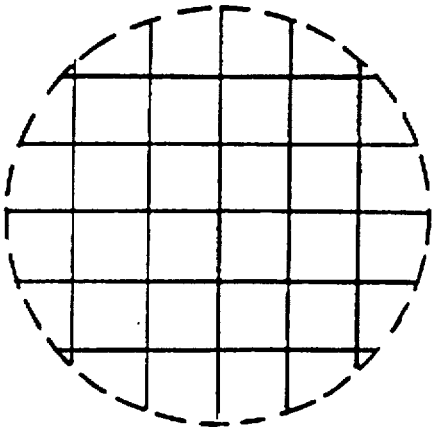
FIG. 19 illustrates an alternative vane configuration.

Tests were then conducted with alternative vanes structures to the six radial vane arrangement illustrated in FIGS. 1 and 2. In particular, an upstream vane assembly was manufactured having an axial appearance as shown in FIG. 19. This vane assembly in effect is made up from a first set of five vanes running perpendicular to a second set of five vanes, the vanes of each set being evenly distributed. Such a vane distribution is familiar from the Zanker conditioner but it is of fundamental importance that in accordance with the present invention the vanes are located upstream of the associated plate in contrast to the arrangement in a Zanker conditioner where the vanes are arranged downstream of the associated plate.

Figure 20:
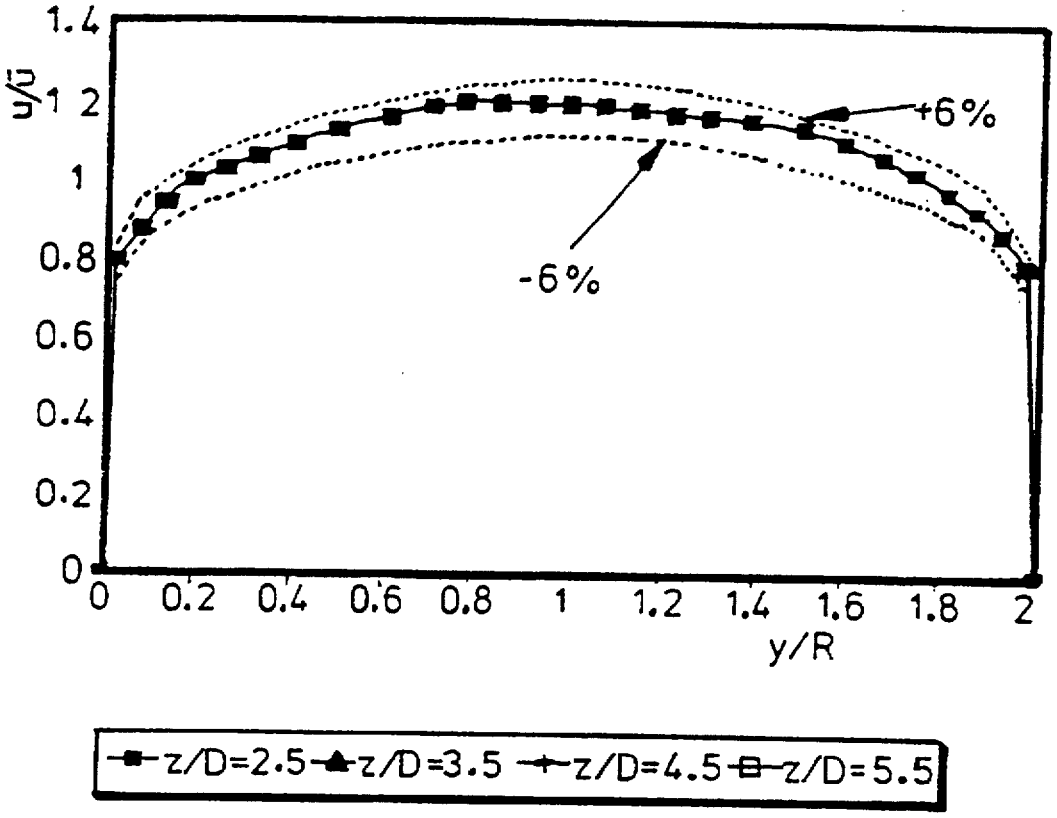
FIGS. 20 and 21 illustrate the performance of an alternative embodiment of the present invention incorporating the vane configuration of FIG. 19.
Figure 21:
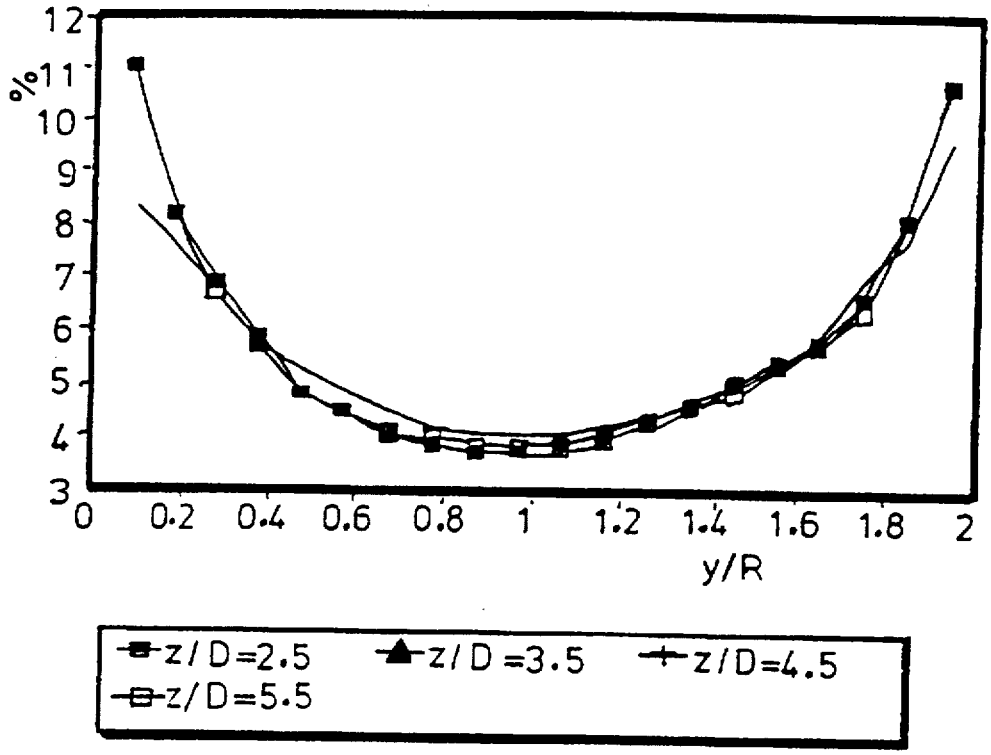

FIG. 20 shows the results obtained with the plate 1 of FIGS. 1 and 2 without the vanes 2 and 3, but with a honeycomb of the form shown in FIG. 19 placed immediately upstream of the plate, the axial length of the honeycomb being equal to one plate diameter. FIG. 20 shows the worst case results, that is valve setting condition C, the lines labelled plus and minus 6% representing the limits recommended in ISO 5167. FIG. 21 compares the axial turbulence intensity profiles measured downstream of the same honeycomb-plate combination with the axial intensity profile measured after one hundred pipe diameters of development length. Clearly the plane surfaces of the honeycomb have resulted in the plate producing a condition very close to fully developed flow in a very short pipe length.

Figure 22:
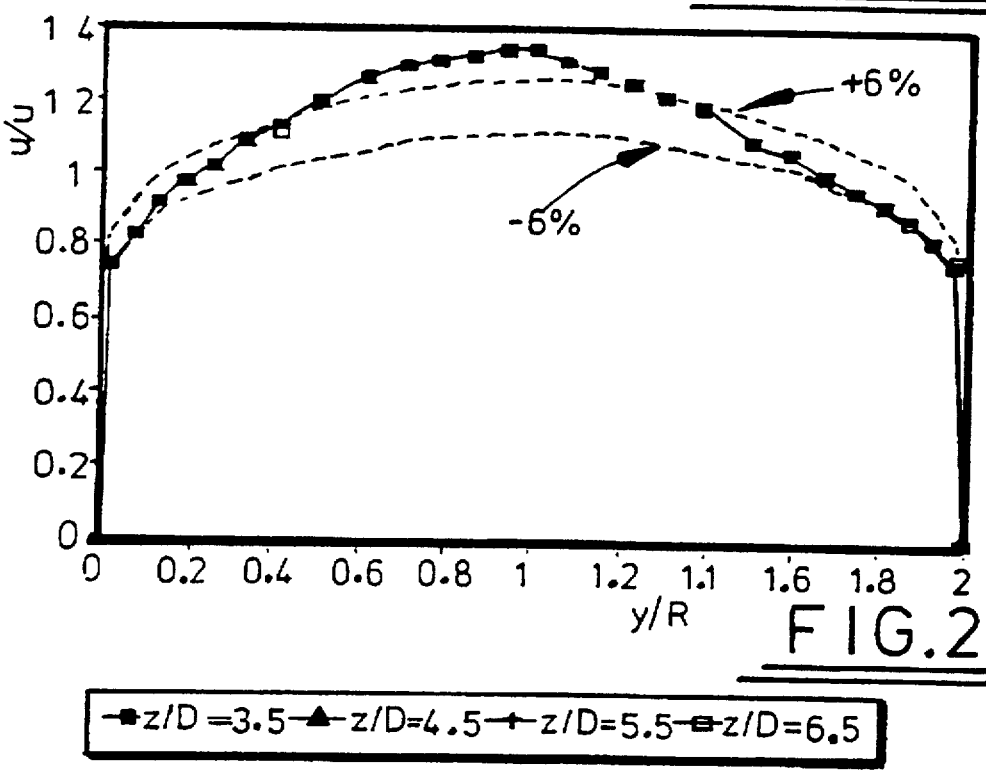
FIGS. 22 and 23 illustrate the performance of a further embodiment of the present invention incorporating the vane configuration of FIG. 19.
Figure 23:
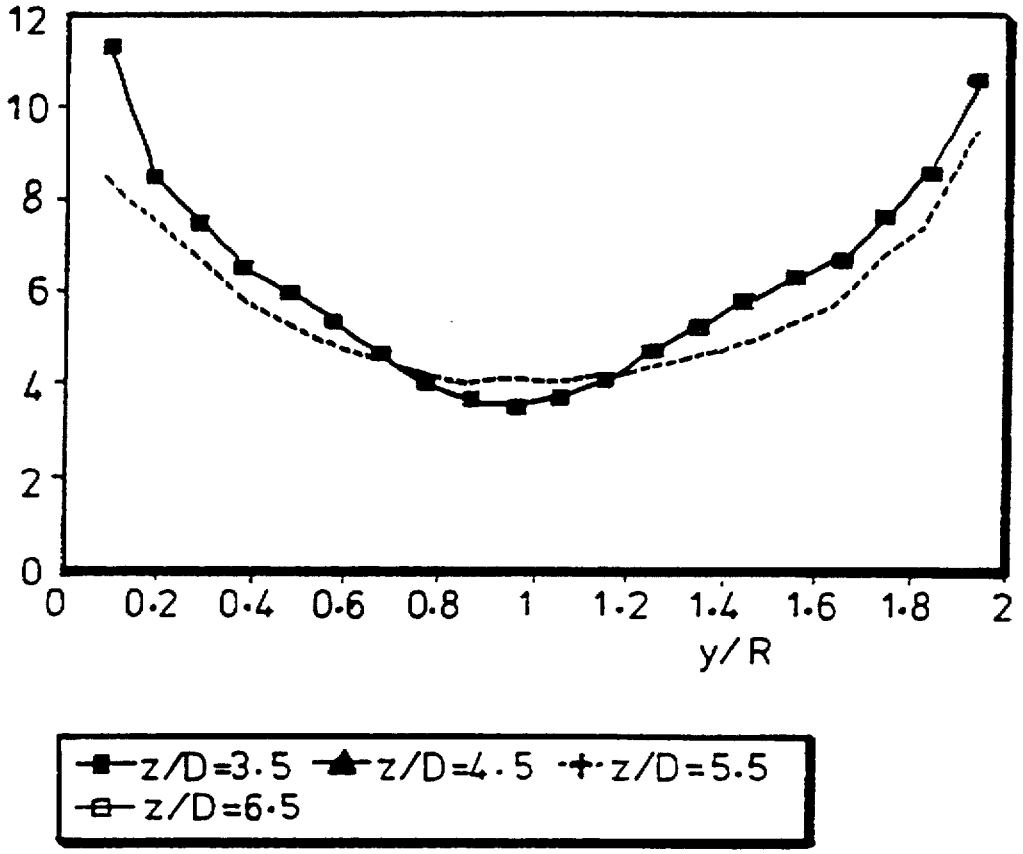

The same honeycomb vane assembly was tested with the plate of FIG. 12. The honeycomb section was placed roughly 0.4 pipe diameters upstream of the plate. FIG. 22 shows the time mean velocity profile results for the worst case condition, that is valve setting C. The profiles are compared with the limits recommended in ISO 5167. Whilst the figures show the results are still not within the limits, the downstream profiles are a significant improvement on those measured for the plate alone (see FIG. 13). The corresponding axial turbulence intensity profiles are shown in FIG. 23. Again these profiles are compared with the full developed distribution. The improvement induced by the presence of the honeycomb is clearly noted from a comparison with the results shown in FIG. 14.

Thus the modification which form the basis of the present invention offer a flow conditioning device capable of operating with very short upstream setting lengths and producing acceptable time mean flow and turbulence intensity profile conditions within a downstream settling length of only a few pipe diameters. These shorter lengths represent a significant step forward in reducing the pipe lengths required for efficient metering stations. Thus the addition of vanes upstream of a flow conditioning device has been demonstrated to reduce the turbulence intensity level in the flow downstream of the plate and to promote the more rapid establishment of fully developed flow conditions. Whilst the radial symmetry of the plate used in the embodiment of FIGS. 1 and 2 lends itself well to the inclusion of vanes on the plate itself, vanes can be used upstream of other flow conditioning devices to improve the downstream flow quality.

I claim:

1. A flow conditioner for insertion into a pipe of predetermined diameter conveying a fluid flow, the conditioner comprising:

a plate arranged perpendicular to the flow and defining apertures which are located so as to distribute the flow radially in approximation to flow distribution of a fully developed flow; and a plurality of vanes distributed such that the normal to each vane is perpendicular to the direction of flow;

wherein each vane extends radially from the pipe wall to a point spaced from the pipe axis.

2. A flow conditioner according to claim 1, wherein each vane extends to a radially outer edge of a central aperture defined in the plate.

3. A flow conditioner for insertion into a pipe of predetermined diameter conveying a fluid flow, the conditioner comprising:

a plate arranged perpendicular to the flow and defining apertures which are located so as to distribute the flow radially in approximation to flow distribution of a fully developed flow; and a plurality of vanes distributed such that the normal to each vane is perpendicular to the direction of flow;

wherein additional vanes are located downstream of the plate and extend axially away from the plate adjacent the wall of the pipe.

4. A flow conditioner according to claim 3, wherein each additional vane extends radially for a distance equal to one eighth of the pope diameter.

5. A flow conditioner for insertion into a pipe of predetermined diameter conveying a fluid flow, the flow conditioner comprising:

a plate arranged perpendicular to a fluid flow direction and having apertures located to distribute the fluid flow radially to approximate a fully developed fluid flow; and a plurality of vanes extending upstream from the plate and distributed such that the normal to each vane is perpendicular to the fluid flow direction;

wherein the vanes extend from the plate such that the apertures of the plate are unobstructed.

6. A flow conditioner according to claim 5, wherein the vanes extend from the plate a distance less than or equal to a diameter of the pipe.

7. A flow conditioner according to claim 5, wherein the vanes extend from the plate parallel to an axis of the pipe.

8. A flow conditioner according to claim 7, wherein the vanes extend from the plate a distance less than one quarter of the pipe diameter.

9. A flow conditioner according to claim 7, wherein the vanes extend from the plate a distance of equal to one eighth of the pipe.

10. A flow conditioner for insertion into a pipe of predetermined diameter conveying a fluid flow, the flow conditioner comprising:

a plate arranged perpendicular to a fluid flow direction and having apertures located to distribute the fluid flow radially to approximate a fully developed fluid flow; and a plurality of vanes extending upstream from the plate and distributed such that the normal to each vane is perpendicular to the fluid flow direction;

wherein each vane extends radially along the plate.

11. A flow conditioner for insertion into a pipe of predetermined diameter conveying a fluid flow, the flow conditioner comprising:

a plate arranged perpendicular to a fluid flow direction and having apertures located to distribute the fluid flow radially to approximate a fully developed fluid flow; and a plurality of vanes extending upstream from the plate and distributed such that the normal to each vane is perpendicular to the fluid flow direction;

wherein a first set of spaced, parallel vanes extend perpendicular to a second set of spaced, parallel vanes.

12. A flow conditioner according to claim 9, wherein each of the first set of spaced, parallel vanes and second set of spaced, parallel vanes comprises an even number of regularly spaces vanes.

13. A flow conditioner for insertion into a pipe of predetermined diameter conveying a fluid flow, the flow conditioner comprising:

a plate arranged perpendicular to a fluid flow direction and having apertures located to distribute the fluid flow radially to approximate a fully developed fluid flow; and a plurality of vanes extending upstream from the plate and distributed such that the normal to each vane is perpendicular to the fluid flow direction;

wherein the apertures comprise a central aperture of the plate, and a plurality of other apertures arranged in circular arrays around the central aperture.

14. A flow conditioner according to claim 13, wherein the other apertures in each circular array are equally spaced around the central aperture and have equal diameters.

15. A flow conditioner according to claim 14, wherein the size and number of the other apertures are such that the impedance to flow caused by the plate increases with the radius on which a given array of apertures is arranged.

16. A flow conditioner for insertion into a pipe of predetermined diameter conveying a fluid flow, the flow conditioner comprising:

a plate arranged perpendicular to a fluid flow direction and having apertures located to distribute the fluid flow radially to approximate a fully developed fluid flow; and a plurality of vanes extending upstream from the plate and distributed such that the normal to each vane is perpendicular to the fluid flow direction;

wherein additional axially extending vanes are located downstream from the plate.

17. A flow conditioner according to claim 16, wherein the additional vanes extend parallel to an axis of the pipe.

18. A flow conditioner according to claim 16, wherein the additional vanes extend from the plate a distance of equal to one eighth of the pipe diameter.

* * * * *